US006637035B1

(12) United States Patent
Brinkmann et al.

(10) Patent No.: US 6,637,035 B1
(45) Date of Patent: Oct. 28, 2003

(54) GLOVE

(75) Inventors: Fritz Brinkmann, Rettenbach (DE); Herbert Lutz, Pfaffenhofen (DE)

(73) Assignee: Pacimex Verpackungen GmbH, Scheyern (DE)

( * ) Notice: Subject to any disclaimer, the term of this patent is extended or adjusted under 35 U.S.C. 154(b) by 0 days.

(21) Appl. No.: 09/937,325

(22) PCT Filed: Mar. 16, 2000

(86) PCT No.: PCT/EP00/02355

§ 371 (c)(1),
(2), (4) Date: Sep. 24, 2001

(87) PCT Pub. No.: WO00/57737

PCT Pub. Date: Oct. 5, 2000

(30) Foreign Application Priority Data

Mar. 25, 1999 (DE) ..... 299 05 510 U

(51) Int. Cl.[7] ..... A41D 19/00
(52) U.S. Cl. ..... 2/161.6; 2/16; 2/167; 15/227
(58) Field of Search ..... 2/16, 20, 161.6, 2/161.7, 163, 164, 167, 168, 169, 170; 15/227

(56) References Cited

U.S. PATENT DOCUMENTS

| | | | | | |
|---|---|---|---|---|---|
| 3,866,245 | A | * | 2/1975 | Sutherland | 2/169 |
| 4,065,826 | A | * | 1/1978 | Hough | 15/227 |
| 4,214,321 | A | * | 7/1980 | Nuwayser | 2/167 |
| 4,804,432 | A | * | 2/1989 | Jurrius et al. | 2/169 |
| 4,928,322 | A | * | 5/1990 | Bradfield | 15/227 |
| 5,301,806 | A | * | 4/1994 | Olson | 2/167 |
| 6,119,272 | A | * | 9/2000 | Tebbe | 2/161.7 |
| 6,298,491 | B1 | * | 10/2001 | Blustin et al. | 2/163 |

* cited by examiner

*Primary Examiner*—John J. Calvert
*Assistant Examiner*—Katherine Moran
(74) *Attorney, Agent, or Firm*—Antonelli, Terry, Stout & Kraus, LLP

(57) ABSTRACT

The invention relates to a glove, especially a disposable glove. Said glove comprises at least two plastic films (6, 7) of substantially the same dimensions that are firmly linked with each other at least in the lateral marginal zones (8), thereby defining the inner (10) and the outer (9) face of the glove and leaving free a glove opening (11). Said glove is further characterized by an absorbing exterior layer (12) that is applied on the outer surface that pertains to the back of the hand and/or the inner surface that permits to the palm.

31 Claims, 3 Drawing Sheets

GLOVE

BACKGROUND OF THE INVENTION

The invention relates to gloves, especially disposable gloves, as are used for example in fueling or in checking a dipstick.

Such disposable gloves are known and consist only of plastic. They are made available for example at filling stations sheet size and dispensed from a roll, in order to enable the customer of the filling station to comfortably carry out simple activities on the vehicle, such as fueling or measuring the oil level. In doing so the paper or the mat is used to clean the hands after fueling or to wipe the dipstick before measuring the oil level.

In the known disposable gloves however it is disadvantageous that they are made of plastic. If accordingly oil or gasoline end up on the glove, it is possible to become dirty when handling the gasoline or benzine. Moreover, in addition to the gloves, the used paper or mat must also be disposed of; this is not desirable.

SUMMARY OF THE INVENTION

Proceeding from the above described defects and deficiencies, the object of this invention is to develop these gloves, especially these disposable gloves, simply and in a manner which is economical to manufacture, such that thus dirty activities, for example wiping the dipstick, are also possible without using separate paper.

This object is achieved as claimed in the invention according to the teaching of the invention by a glove, especially by a disposable glove, with at least two essentially congruent plastic films which at least on the lateral edge areas are joined to one another securely with the formation of an outside and an inside and leaving a glove opening, and with at least one absorbent outside layer which is applied externally to the outside which can be assigned to the outside surface of the hand and/or to the inside which can be assigned to the inside surface of the hand.

Accordingly, as claimed in the invention a glove is made available which is externally provided on its outside, but preferably only on its inside, with an effectively superabsorbent outside layer of paper or (paper) mat. This paper or mat layer can be kept very thin so that considerable material can be saved; according to the prior art this material is necessary in a paper or mat dispenser.

In one advantageous development of this invention the absorbent outside layer can be statically charged, especially electrostatically charged and/or magnetostatically charged so that the glove is advantageously also suited for wiping dirt, since by using an outside layer material with high static charging capacity the dirt collects especially easily on the outside layer. This takes place especially efficiently when the outside layer has iron shavings in powdered form.

In order to reliably prevent formation of disease-causing germs or the like when this invention is used as a cosmetic glove and/or as a medical glove, the outside layer according to one preferred embodiment of this invention has at least one disinfecting and/or germicidal additive, for example in the form of a disinfectant which can be delivered as an additive to the outside layer. One major advantage in this connection is that these disinfectant and/or germicidal additives can be metered very exactly, and for example ground spices in the (paper) mat material can be imagined.

It is a good idea if the absorbent outside layer, as was mentioned above, has paper or mat and if the plastic film is bondable and/or sealable; preferably the plastic film consists of polyethylene (PE), which material offers the advantage that under certain assumptions it can be permeable to air, but not to liquid; in contrast, polypropylene (PP) can be permeable to liquid when certain conditions prevail, but not to air.

According to one advantageous development of this invention at least one of the plastic. films is microperforated at least in places. In this way a glove which can to a certain extent breathe is made available since the plastic films do not allow any liquid exchange, but very probably air exchange; this has the positive effect that unpleasant sweating of the hand in the glove can be avoided.

The essentially congruent plastic films can preferably be made roughly rectangular in a plan view. The plastic films are easily formed from a plastic web which extends in the lengthwise direction and which is folded in the form of a hose, the fold edge which extends in the lengthwise direction forming the top of the glove in the area of the fingertips of the hand which has been inserted therein and the two edges opposite the fold edge forming the glove opening; the gloves are accordingly transversely next to one another.

According to one especially inventive development of this glove, the two edges which are opposite the fold edge and which form the glove opening can be arranged offset to one another. In this way especially comfortable insertion of the hand into the glove is enabled, since the user of the glove can optionally compensate for the fact that the two plastic films may adhere to one another by his easily grasping the projecting edge and gently pulling the two plastic films apart.

As a result, moreover in the area of the fold edge there need not be a bond seam or seal seam; this simplifies production of the glove. Only on the lateral edge areas are the congruent plastic films feasibly joined to one another by cementing and/or by bonding and/or by sealing. The gloves can however advantageously be turned at a right angle, moreover can be formed in succession from the plastic web.

In one feasible embodiment, instead of a roughly rectangular interior or also an interior which is roughly round or at least rounded for the hand, the glove can have at least in areas at least one bond or seal seam which runs at a distance from the side edge areas and/or from the fold edge, in the form of a fingered glove (with up to six receiving areas for the finger, but also with receiving areas in which two or more fingers can be accommodated next to one another at the same time) or in the form of a mitten; in this way the glove is made to have a better grip and to be easier to handle.

Advantageously the bond or seal seam in a plan view can have a thumb section for holding the thumb on both sides of the finger area. Thus gloves for the left hand and gloves for the right hand need not be produced separately; rather each glove can be worn on the left and right such that the absorbent outside layer is assigned to the inside of the glove.

Furthermore, in one feasible embodiment of this invention it is intended that for the two congruent plastic films there be at least one other congruent plastic film on the side opposite the outside layer, this other plastic film being connected at least to the adjacent plastic film via another bond or seal seam which runs with a distance from the bond or the seal seam in the form of a fingered glove or in the form of a mitten, but essentially parallel thereto.

The latter bond or seal seam should take up a larger area than the former bond or seal seam, by which between two adjacent congruent plastic films at a time a glove is formed, but with a different size. Thus the gloves can be easily used for quite large hands and also for quite small hands without adversely affecting the comfort of use.

There are preferably two or more disposable gloves in the lengthwise direction of the plastic web depending on the arrangement on the plastic web next to one another or in succession, and the individual gloves can be easily separated by at least one linear perforation which runs transversely to the lengthwise direction. Thus the gloves as claimed in the invention can be unrolled in the lengthwise direction and can be dispensed individually by means of a dispenser.

If the glove as claimed in this invention is to be developed especially advantageously, it is recommended that in the area of the glove opening there be at least one locking closure with at least one fixing or closing strip which extends essentially transversely to the insertion direction of the hand. Preferably therefore at least one fixing or closing strip is formed which is located in the area of the so-called "turn-back" of the glove and with which the glove opening can be closed after insertion of the hand into the glove.

On the one hand, there is no additional material cost associated with the arrangement of the locking closure in the area of the glove opening, i.e. in the turnback area, because the material which is necessary for the locking closure is made available anyway by the plastic film(s) and on the other hand would only be scrap; on the other hand, by providing the locking closure and the resulting closing function in the area of the glove opening, the hand is reliably prevented from slipping out of the glove since the turnback area which may otherwise tend to uncontrolled flapping and under unfavorable conditions in the extreme case to unwanted incipient tearing, i.e. the area of the glove opening, can be fixed and closed by the locking closure.

In one special embodiment the fixing or closing strip has two ends, preferably one end being provided on one side of the glove opening and the other end being provided on the other side of the glove opening. An especially good closing action with reference to the glove opening is achieved when one end can be turned down onto the other end and when the ends can be detachably secured to one another.

In this connection it is recommended that one end be made as a receiving part which has at least one clear opening area and the other end be made as an-insertion part which is provided for insertion into the opening area and which is matched to the opening area. Feasibly then the insertion part can be turned down onto the receiving part and can be detachably secured to the receiving part by the insertion part being inserted into the receiving part which has the opening area and thus being detachably secured to the receiving part.

The above described locking and fixing principle functions for the area of the glove opening to be closed for example in a preferable manner when the receiving part is located on one side of the glove opening and when the insertion part is located on the other side of the glove opening. In this constellation it is reliably guaranteed that the insertion part can be turned down onto the receiving part and can be detachably secured to the receiving part.

Alternatively or in addition, the fixing or the closing strip can be knotted and/or tied and/or can be detachably secured by means of cement or by means of at least one adhesive spot or by means of at least one adhesive strip or by means of a tape.

According to one especially inventive development of this invention, on the outside there is at least one carrier strip. This carrier strip on the one hand has a stabilizing function, especially when the gloves as claimed in the invention are unrolled in the lengthwise direction and are delivered individually by means of a dispensing device; on the other hand, the carrier strip can also be used as a holder for the glove, especially when there is carrier strip in a material-saving manner instead of the plastic film which forms the outside.

In the latter case the hand of the user is inserted between the carrier strip and the plastic film which forms the inside, i.e. the carrier strip then acts to a certain extent as a holding strip or a holding device which is pulled over the back of the hand. In this connection an especially advantageous function is ensured when there are two carrier strips which are located roughly parallel to one another.

Other embodiments, features and advantages of this invention are described below in the drawings using FIGS. 1 to 5 which illustrate two embodiments of these gloves in sample form.

BRIEF DESCRIPTION OF THE PREFERRED EMBODIMENTS

DETAILED DESCRIPTION OF THE PREFERRED EMBODIMENTS

Figure 1:
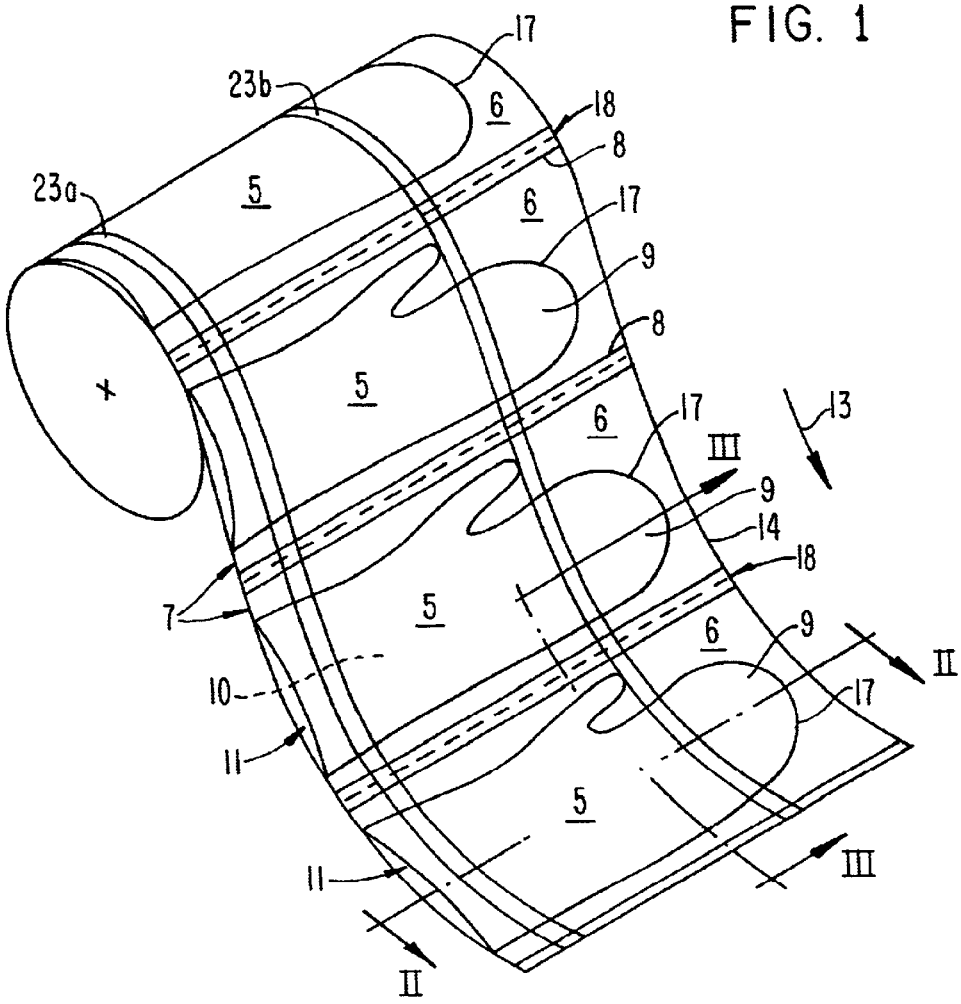
FIG. 1 shows a host of disposable gloves which are located next to one another transversely in the lengthwise direction according to a first embodiment, in a perspective schematic.

FIG. 1 labels the disposable gloves according to a first embodiment of this invention with reference number 5. They have two congruent plastic films 6, 7 which are rectangular in a plan view and which are joined to one another securely by cementing or by bonding or by sealing in the edge areas 8 with the formation of an outside (back side) 9 and an inside (palm side) 10, leaving a glove opening 11.

Furthermore, the glove 5 as claimed in the invention is provided on the inside 10 externally with an absorbent outside layer 12 which consists of paper (mat). The plastic films 6, 7 are conversely made of polyethylene (PE) and are microperforated so that a glove 5 which can to a certain extent breathe is made available which allows air exchange; this has the positive consequence that unpleasant sweating of the hand in the glove 5 can be prevented.

The congruent plastic films 6, 7 are formed from a plastic web which extends in the lengthwise direction 13 and which is folded in the form of a hose, the folded edge 14 which extends in the lengthwise direction 13 forming the top of the glove 5 in the area of the fingertips and the two edges 15, 16 which lie opposite the fold edge 14 forming the glove opening 11.

Figure 2:
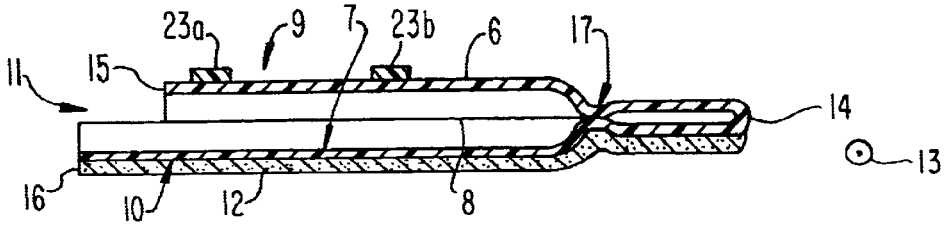
FIG. 2 shows a representation along the section line II—II from FIG. 1.

As can be taken from FIG. 2 (=representation along the section line II—II from FIG. 1) the two edges 15, 16 which form the glove opening 11 and which lie opposite the fold edge 14 are arranged offset to one another. In this way especially comfortable insertion of the hand into the glove 5 is enabled, since the user of the glove 5 can optionally compensate for the fact that the two plastic films 6, 7 may adhere to one another by his grasping the projecting edge 16 and gently pulling the two plastic films 6, 7 apart.

Figure 3:
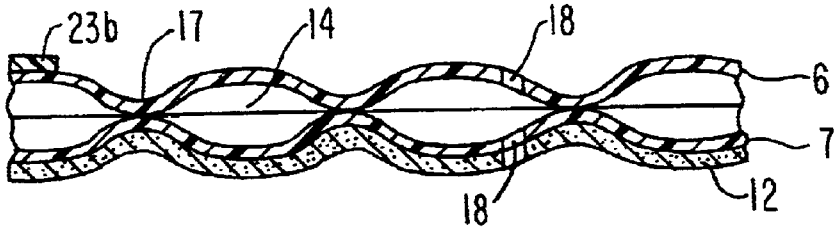
FIG. 3 shows a representation along the section line III—III from FIG. 1.

The congruent plastic films 6, 7 which are joined to one another on the lateral edge areas 8 by bonding or by sealing furthermore have in areas a seal seam 17 which runs at a distance from the edge areas 8 and/or from the fold edge 14, in the first embodiment shown in FIGS. 1 to 3 in the form of a mitten.

As FIG. 1 shows, there is a host of disposable gloves 5 next to one another in the lengthwise direction 13 of the plastic web, which can be easily separated by one linear perforation 18 at a time which runs essengially at a right angle to the lengthwise direction 13, but are still joined to one another.

As FIGS. 1 to 3 further show, on the outside 9 of the glove 5 there are two carrier strips 23*a*, 23*b* which are located parallel to one another. These carrier strips 23*a*, 23*b* on the one hand have a stabilizing function, especially when the gloves 5 are unrolled in the lengthwise direction 13 (compare FIGS. 1 and 2) and are delivered individually by means of a dispensing device; on the other hand, the carrier strips 23*a*, 23*b* can also be used as a holder for the glove 5, and in an inventive manner also such that there is or are a carrier strip 23 or carrier strips 23*a*, 23*b* instead of the plastic film 6 which forms the outside 9 (see FIG. 6).

In the latter case the hand of the user is inserted between the carrier strips 23*a*, 23*b* and the plastic film 7 which forms the inside 10, i.e. the carrier strips 23*a*, 23*b* then act as holding strips which are pulled over the back of the hand.

In the second embodiment which is alternative to FIGS. 1 to 3, in contrast to the first embodiment in which the gloves 5 are arranged horizontally crosswise next to one another, the gloves 50 are arranged in succession horizontally in the lengthwise direction 13. Here the top of the glove 50 which is adjacent to the fingertips is provided with a seal seam 8 which runs transversely to the lengthwise direction 13. Parallel to this seal seam 8, but on the side facing away from the top of the glove 50 there is a linear perforation 18 which forms the glove opening 11 upon separation.

As follows from FIG. 4, the seal seam 17 of the glove 50 in a plan view on both sides of the finger area (defined by the little finger, ring finger, middle finger and index finger) has a thumb section 51 which is used to accommodate the thumb and moreover a glove 50 which is to a certain extent mirror-symmetrical with respect to the lengthwise direction 13.

Figure 4:
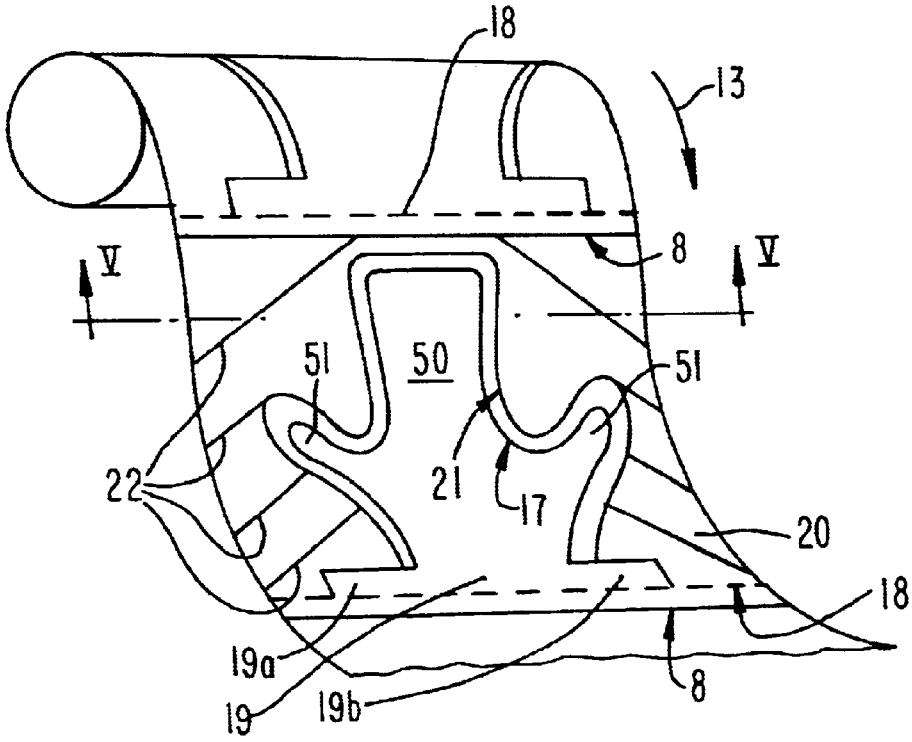
FIG. 4 shows a host of disposable gloves which are located next to one another transversely in the lengthwise direction according to a second embodiment, in a perspective schematic.

It furthermore follows from FIG. 4 that in the area of the glove opening 11 there is a locking closure with a fixing or closing strip 19 which extends transversely to the insertion direction of the hand. This fixing or closing strip 19 has two ends 19*a*, 19*b*, one end 19*a* being on the side of the glove opening 11 which is the left side in FIG. 4 and the other end 19*b* being on the side of the glove opening 11 which is the right side in FIG. 4.

On the one hand, there is no additional material cost associated with providing this fixing or closing strip 19 which is located in the area of the so-called "turnback" of the glove 50 and with which the glove opening 11 can be closed after insertion of the hand into the glove 50, because the material which is necessary for the fixing or closing strip 19 is made available anyway by the plastic films 6 and 7 and otherwise would only be scrap; on the other hand, by providing the fixing or closing strip 19 and the resulting closing function in the area of the glove opening 11 the hand is reliably prevented from slipping out of the glove 50 since the turnback area which may otherwise tend to uncontrolled flapping and under unfavorable conditions in the extreme case to unwanted incipient tearing, i.e. the area of the glove opening 11, can be fixed and closed by the fixing or closing strip 19.

In the special embodiment of FIG. 4 one end 19*a* is on the side of the glove opening 11 which is the left side in FIG. 4 and the other end 19*b* is on the side of the glove opening 11 which is the right side in FIG. 4. An especially good closing action with reference to the glove opening 11 can be achieved here by the fact that one end 19*a* can be turned down onto the other end 19*b* and that the two ends 19*a*, 19*b* can be detachably secured to one another by means of two adhesive strips which are protected against fouling first of all by silicone-treated coverings.

Figure 5:
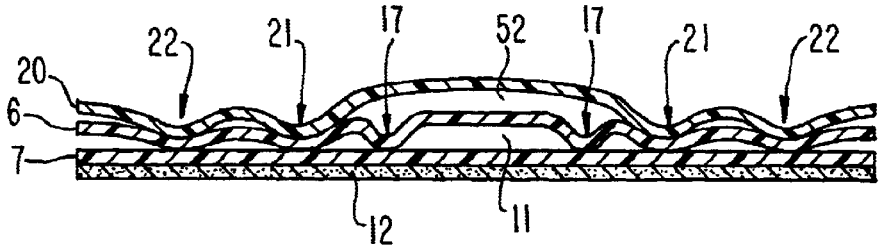
FIG. 5 shows a representation along the section line V—V from FIG. 4.

In addition, FIG. 5 shows in cross section that on the side of the glove 50 which is opposite the electrostatically chargeable outer layer 12 which is provided with a disinfecting additive, another congruent plastic film 20 with another seal seam 21 which encloses a larger area than the seal seam 17, but which runs at a distance to the latter to a certain extent parallel, is applied to the two congruent plastic films 6, 7. This yields another glove which is produced in one process with a glove opening 52, this glove being made larger than the glove formed by the two congruent plastic films 6, 7.

To impart stability of shape to the glove 50, outside the area of the seal seam 17 (compare the first embodiment as shown in FIGS. 1 to 3) or outside the other seal seam 21 (compare the second embodiment as shown in FIGS. 4 and 5) there are stabilization connections 22 which are made as seal seams in the second embodiment shown.

Figure 6:
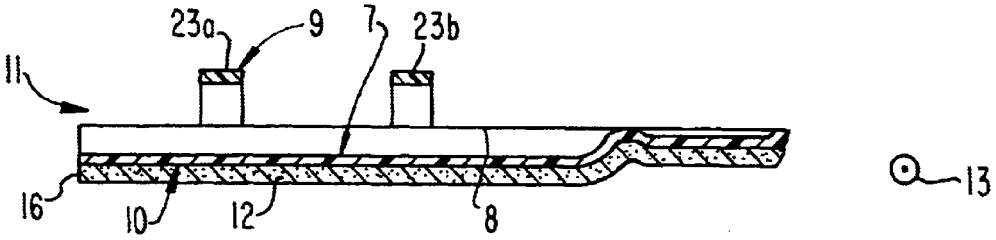
FIG. 6 shows a cros-sectional view of another embodiment of the invention.

FIG. 6 shows a cross-sectional view of another embodiment in which the outside layer 12 is applied externally only to the inside or palm side 10.

Thus, the area of the parts which are rectangular in a plan view, and which can be separated along the perforation 18, i.e. the area which remains outside the actual glove 5 or 50, is stable and is not disruptive when the globe 5 or 50 is being used.

What is claimed is:

1. Glove, comprising at least two essentially congruent plastic films which at least on a portion of the lateral edge areas are joined to one another securely with the formation of palm side and a back side and leaving a glove opening; and at least one absorbent outside layer applied externally to at least one of the palm side and the back side, wherein the outside layer includes iron shavings in powdered form and is statically charged.

2. Glove as claimed in claim 1, wherein the at least one absorbent outside layer is applied externally only to the palm side.

3. Glove as claimed in claim 1, wherein the at least one absorbent outside layer is paper or mat.

4. Glove as claimed in claim 1, wherein the at least one absorbent outside layer is electrostatically charged or magnetostatically charged.

5. Glove as claimed in claim 1, the plastic films are joined by at least one bond or seal seam distanced from the lateral edge areas and defining outer edges of a fingered glove or mitten which in plan view has a finger area and a pair of thumb sections used for holding the thumb on both sides of the finger area.

6. Glove comprising first and second congruent plastic films which at least on a portion of the lateral edge areas are joined to one another securely with the formation of a palm side and a back side and leaving a glove opening, the first and second films also being joined by at least one first bond or seal seam distanced from the lateral edge areas and defining outer edges of a first fingered glove or mitten;

at least one absorbent outside layer applied externally to the palm side; and a third congruent plastic film provided on the back side opposite the outside layer, the third plastic film being connected to the adjacent plastic film by a second bond or seal seam which runs with a distance from the first bond or the seal seam to define a second fingered glove or mitten of different size than the first fingered glove or mitten.

7. Glove as claimed in claim 6, wherein the second bond or seal seam takes up or encloses a larger area than toe first bond or seal seam.

8. Glove as claimed in claim 6, wherein outside an area taken up or enclosed by an outer one of the first bond or seal seam and the second bond or seal seam there is at least one stabilization connection.

9. Glove as claimed in claim 8, wherein the at least one stabilization connection comprises at least one seam selected from the group consisting of a cement seam, a bond seam and a seal seam.

10. Glove as claimed in claim 6, wherein each of the first and second bond or seal seams have a shape in plan view forming a finger area and a pair of thumb sections used for holding the thumb on both sides of the finger area.

11. Glove comprising at least two essentially congruent plastic films which at least on a portion of the lateral edge areas are joined to one another securely with the formation of palm side and a back side and leaving a glove opening; and at least one absorbent outside layer applied externally to at least one of the palm side and the back side; and two carrier strips located roughly parallel to one another on the plastic film on the back side of the glove.

12. Glove as claimed in claim 11, wherein the plastic films are also joined by at least one bond or seal seam distanced from the lateral edge areas and defining outer edges of a fingered glove or mitten which in a plan view has a finger area and a pair of thumb sections used for holding the thumb on both sides of the finger area.

13. Glove as claimed in claim 7, wherein the outside layer includes at least one additive selected from the group consisting of a disinfecting additive and a germicidal additive.

14. Glove as claimed in claim 12, wherein the plastic films are joined to one another by at least one joining method selected from the group consisting of cementing, bonding and sealing.

15. Glove as claimed in claim 12, wherein at least one of the plastic films is made of a material selected from the group consisting of polyethylene, polypropylene and copolymers.

16. Glove as claimed in claim 12, wherein at least one of the plastic films is microperforated at least in places.

17. Glove as claimed in claim 12, wherein the plastic films in a plan view have a shape selected from the group consisting of roughly rectangular, roughly round and rounded.

18. Glove as claimed in claim 12, wherein the plastic films are formed from a plastic web which extends in the lengthwise direction and which is folded substantially in half.

19. Glove as claimed in claim 18, wherein a fold edge which extends in the lengthwise direction forms the top of the glove in the area of the fingertips and wherein two edges opposite the fold edge form the glove opening.

20. Glove as claimed in claim 19, wherein the two edges which are opposite the fold edge and which form the glove opening are arranged offset to one another.

21. Glove as claimed in claim 18, wherein there are two or more gloves in the lengthwise direction of the plastic web transversely next to one another and wherein the gloves are joined to one another to be easily separated by at least one linear perforation which runs transversely to the lengthwise direction.

22. Glove as claimed in claim 21, wherein at a distance to the perforation there is at least one additional bond or seal seam which joins the plastic films to one another and which forms the top of the glove in the area of the fingertips.

23. Glove as claimed in claim 21, wherein the gloves which are joined to one another via the at least one linear perforation are unrolled in the lengthwise direction and can be dispensed individually by means of a dispenser.

24. Glove as claimed in claim 12, wherein the plastic films are formed from a plastic web which extends in the lengthwise direction.

25. Glove as claimed in claim 24, wherein a top of the glove in the area of the fingertips and the glove opening which is opposite the top in the lengthwise direction are located at a distance to one another.

26. Glove as claimed in claim 24, wherein there are two or more gloves in the lengthwise direction of the plastic web in succession, and wherein the gloves are joined to one another to be easily separated by at least one linear perforation which runs transversely to the lengthwise direction with the formation of the glove opening.

27. Glove as claimed in claim 12, further comprising at least one locking closure provided in the area of the glove opening, the at least one locking closure comprising at least one fixing or closing strip which extends essentially transversely to the insertion direction of the hand.

28. Glove as claimed in claim 27, wherein the fixing or closing strip has two ends.

29. Glove as claimed in claim 28, wherein one end of the fixing or closing strip is provided on one side of the glove opening and another end of the fixing or closing strip is provided on the other side of the glove opening.

30. Glove as claimed in claim 28, wherein one end of the fixing or closing strip can be turned down onto another end of the fixing or closing strip and wherein the two ends can be detachably secured to one another.

31. Glove as claimed in claim 27, wherein the fixing or the closing strip is adapted to fix or close the glove by one of being knotted, tied, detachably secured by means of cement, detachably secured by means of at least one adhesive spot, detachably secured by means of at least one adhesive strip, and detachably secured by means of at least one tape.

* * * * *